US007568363B2

(12) United States Patent
Runbalk

(10) Patent No.: US 7,568,363 B2
(45) **Date of Patent: *Aug. 4, 2009**

(54) TREATING OF A CRUDE CONTAINING NATURAL GAS

(75) Inventor: David Bertil Runbalk, The Hague (NL)

(73) Assignee: Shell Oil Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/942,497

(22) Filed: Nov. 19, 2007

(65) Prior Publication Data

US 2008/0072620 A1 Mar. 27, 2008

Related U.S. Application Data

(63) Continuation of application No. 10/489,585, filed as application No. PCT/EP02/10365 on Sep. 13, 2002, now Pat. No. 7,309,417.

(30) Foreign Application Priority Data

Sep. 13, 2001 (EP) ..... 01307815

(51) Int. Cl.
*F25J 1/02* (2006.01)

(52) U.S. Cl. ..... 62/611; 62/24; 62/31; 62/34; 62/612; 208/306; 208/308; 208/340; 208/351; 208/352; 208/353; 208/354; 208/361; 55/40; 55/43; 55/46; 55/51

(58) Field of Classification Search ..... 208/306, 208/308, 340, 351, 352, 353, 354, 361; 62/24, 62/31, 34, 611, 612; 55/40, 43, 46, 51
See application file for complete search history.

(56) References Cited

U.S. PATENT DOCUMENTS 4,116,821 A 9/1978 Peiser ..... 208/361
4,824,445 A * 4/1989 Minkkinen ..... 95/158
5,030,339 A 7/1991 Czarnecki ..... 208/351
6,658,891 B2 12/2003 Reijnen et al. ..... 62/611

FOREIGN PATENT DOCUMENTS

FR 2584087 1/1987
FR 2600338 12/1987

OTHER PUBLICATIONS

Kirk-Othmer Encyclopedia of Chemical Technology,d.3, vol. 7,Copper Alloys to Distillation, US, New-York, 1978, p. 860.
Perry's Chemical Engineer's Handbook, Ed. 6, US, New-York, 1984, p. 22-115/22-117.
International Search Report dated Dec. 16, 2002.

* cited by examiner

*Primary Examiner*—Glenn Caldarola
*Assistant Examiner*—Prem C. Singh

(57) ABSTRACT

A process for treating a crude containing natural gas comprising supplying the crude to a stabilization unit to obtain a gaseous stream and crude oil; supplying a compressed, gaseous stream at a low temperature to the bottom of a first column; partly condensing the first gaseous overhead stream, returning the liquid phase to the first column and supplying the methane-rich stream to a liquefaction plant; supplying an expanded bottom stream at a low temperature to the top of a second column; removing from the top of the second column a second gaseous overhead stream, and removing from the bottom of the second column a liquid bottom stream; vaporizing part of the bottom stream and introducing the vapor into the bottom of the second column; and introducing the remainder of the bottom stream into a crude oil stream at an appropriate point in or upstream of the stabilization unit, wherein the amount of heat removed from the first gaseous overhead stream is so adjusted that the concentration of $C_5^+$ in the first gaseous overhead stream is below a predetermined value, and wherein the fraction of the liquid bottom stream from the second column that is vaporized is so selected that the concentration of $C_{2-}$ in the liquid bottom stream is below a predetermined level.

19 Claims, 1 Drawing Sheet

TREATING OF A CRUDE CONTAINING NATURAL GAS

This application is a continuation of U.S. application Ser. No. 10/489,585 having a 35 U.S.C. 371 date of Mar. 12, 2004, now U.S. Pat. No. 7,309,417, that was PCT filed Sep. 13, 2002 having PCT No. PCT/EP02/10365 claiming priority from European Patent Application No. 01307815.9 filed Sep. 13, 2001, which are all incorporated herein by reference.

The present invention relates to treating a crude containing natural gas. In the specification and in the claims the expression 'crude containing natural gas' is used to refer to crude oil with which natural gas is produced. The natural gas is then called associated gas. In the specification and in the claims the expression 'treating a crude containing natural gas' is referred to treating the crude to obtain a stabilized crude oil and a gaseous stream that can be passed directly to a liquefaction plant.

Stabilizing a crude oil in a stabilization unit is a well-known technique to produce stabilized crude oil and a gaseous stream. Suitably the stabilization unit is a multi-stage separator.

In addition it is well known to remove a $C_2^+$-containing stream from the gaseous stream to obtain a gaseous stream that is enriched in methane and that can be passed directly to a liquefaction plant and a $C_2^+$-containing stream. The $C_2^+$-containing stream can be used as fuel gas, to produce liquefied petroleum gas or to provide components for the refrigerants used in the liquefaction plant.

Reference is made to U.S. Pat. No. 5,030,339. This publication discloses a process for treating a crude containing natural gas, which process comprises:

(a) supplying the crude to a stabilization unit to obtain a gaseous stream, a first condensate stream and crude oil;
(b) partly condensing the gaseous stream at an elevated pressure in a refluxing heat exchanger to obtain export gas and a second condensate stream;
(c) combining the first and second condensate streams, allowing the combined condensate stream to expand and heating the condensate stream;
(d) supplying the expanded condensate stream to a column;
(e) removing from the top of the column a fuel gas stream, and removing from the bottom of the column a liquid bottom stream;
(f) vaporizing part of the liquid bottom stream and introducing the vapour into the bottom of the column; and
(g) combining the remainder of the liquid bottom stream with the crude oil stream.

There are instances where it is desirable to minimize the fuel gas stream, without sacrificing the requirement of producing a stabilized crude oil and producing a methane-rich stream that can be passed directly to a liquefaction plant. In addition, there is a need to meet more stringent requirements on the concentrations of $C_5^+$ in the product gas of and $C_2^-$ in the crude oil.

To this end the process for treating a crude containing natural gas according to the present invention comprises:

(a) supplying the crude to a stabilization unit to obtain a gaseous stream and crude oil;
(b) cooling the gaseous stream at an elevated pressure and supplying the gaseous stream at a low temperature to the bottom of a first column;
(c) removing from the top of the first column a first gaseous overhead stream, partly condensing the gaseous overhead stream, separating the liquid phase from the partly condensed overhead stream to obtain a methane-rich stream, returning the liquid phase to the top of the first column and supplying the methane-rich stream to a liquefaction plant;
(d) removing a bottom stream from the first column, allowing the bottom stream to expand to a lower pressure, and supplying the expanded bottom stream at a low temperature to the top of a second column;
(e) removing from the top of the second column a second gaseous overhead, and removing from the bottom of the second column a liquid bottom stream;
(f) vaporizing part of the liquid bottom stream and introducing the vapour into the bottom of the second column; and
(g) introducing the remainder of the liquid bottom stream into a crude oil stream at an appropriate point in or upstream of the stabilization unit, wherein the amount of heat removed from the first gaseous overhead stream is so adjusted that the concentration of $C_5^+$ in the first gaseous overhead stream is below a predetermined value, and wherein the fraction of the liquid bottom stream from the second column that is vaporized is so selected that the concentration of $C_2^-$ in the liquid bottom stream is below a predetermined level.

An advantage of the process of the present invention is that it can be used on a floating system for producing liquefied natural gas because the $C_2^+$-containing stream is not produced as a separate stream. Thus there is no need for separate off-loading facilities for liquefied petroleum gas, which simplifies the floating system.

Figure 1:
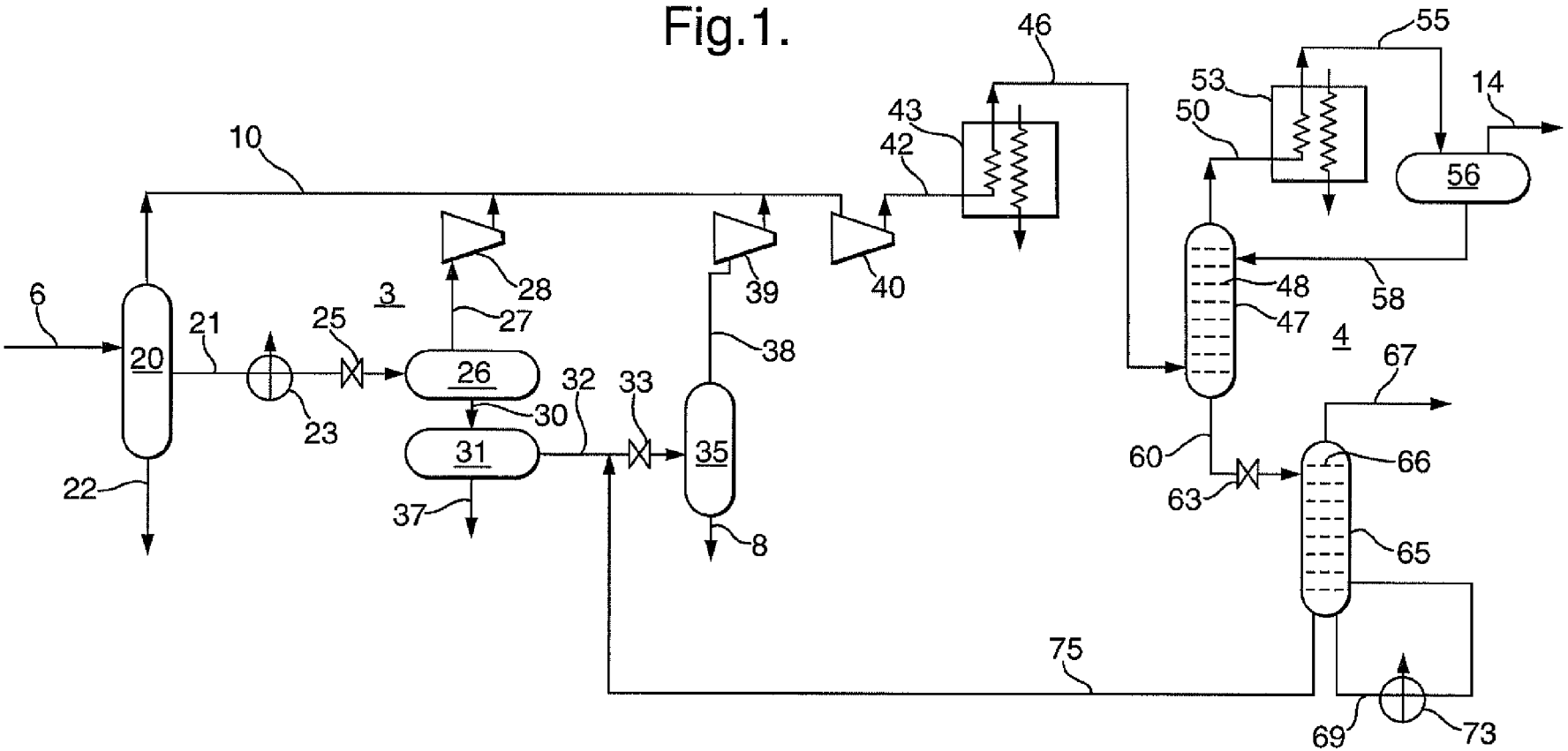
FIG. 1 shows schematic diagram of an embodiment of the invention.

The invention will now be discussed by way of example in more details with reference to the accompanying drawing showing schematically a flow sheet of the plant in which the method of the present invention can be carried out.

The plant comprises a stabilization unit 3 and a fractionation unit 4. The crude containing natural gas is supplied through conduit 6 to the stabilization unit 3. Stabilized crude oil is removed from the stabilization unit 3 through conduit 8, and a gaseous stream is removed from the stabilization unit 3 through a gas-collecting conduit 10.

The gaseous stream removed through the gas-collecting conduit 10 is supplied to the fractionation unit 4, and a methane-rich stream is removed from the fractionation unit 4 through conduit 14. This methane-rich stream is supplied to a plant for liquefying natural gas (not shown).

We will first discuss the stabilization unit 3 and then we will discuss the fractionation unit 4.

The crude containing natural gas supplied through the conduit 6 is supplied to a high-pressure separator 20. A high-pressure gaseous stream is withdrawn from the high-pressure separator 20 through the gas-collecting conduit 10, and oil is removed through conduit 21. If water is present in the crude, it is removed through conduit 22. The oil removed through conduit 21 is passed through an optional heater 23 and a pressure-reduction valve 25 to a low-pressure separator 26. A low-pressure gas stream is withdrawn from the low-pressure separator 26 through conduit 27, and before it is introduced in the gas-collecting conduit 10 its pressure is increased using compressor 28. Oil is removed from the low-pressure separator 26 through conduit 30. The oil is passed via an optional oil/water separator 31 through conduit 32 provided with a pressure-reduction valve 33 to an atmospheric separator 35. Water is removed from the optional oil/water separator 31 through conduit 37. The atmospheric separator 35 is the last separator of the stabilization unit 3, and from the atmospheric separator 35 stabilized oil is withdrawn through conduit 8 and a gaseous stream is withdrawn through conduit 38, and before it is introduced in the gas-collecting conduit 10 its pressure is increased using compressor 39.

Now the fractionation unit 4 is discussed in more detail. The gaseous stream supplied through conduit 10 is brought to an elevated pressure—if necessary—by compressor 40, and at elevated pressure the gaseous stream is supplied through conduit 42 to a heat exchanger 43, in which it is cooled to a low temperature by indirect heat exchange with a suitable refrigerant. The refrigerant is suitably a refrigerant that is also used in the liquefaction plant. The gaseous stream is supplied at low temperature through conduit 46 to the bottom of a first column 47 provided with a suitable number of theoretical separation stages 48. Suitably the number of theoretical separation stages 48 is in the range of from 10 to 30. From the first column 47 a first gaseous overhead stream is removed through conduit 50, which first gaseous overhead stream is supplied to a heat exchanger 53, in which it is cooled to a low temperature by indirect heat exchange with a suitable refrigerant so as to partly condense the gaseous overhead stream. The refrigerant is suitably a refrigerant that is also used in the liquefaction plant. The partly condensed gaseous overhead stream is supplied through conduit 55 to a gas/liquid separator 56 to obtain a methane-rich stream that is supplied through conduit 14 to the plant for liquefying this gas. The liquid phase is returned through conduit 58 from the gas/liquid separator 56 to the first column 47.

The first column 47 is a rectifying column operating at full reflux conditions. The amount of heat removed from the gaseous overhead stream is so adjusted that the concentration of $C_5^+$ in the gaseous overhead stream from the first column 47 is below a predetermined value. Suitably the concentration of $C_5^+$ is less than 0.1 mol %.

The bottom stream removed from the first column 47 is passed through conduit 60 provided with a pressure reduction valve 63 at a low temperature directly to the top of a second column 65 provided with a suitable number of theoretical separation stages 66. Suitably the number of theoretical separation stages 48 is in the range of from 10 to 30. From the top of the second column 65 a second gaseous overhead is removed through conduit 67. The second gaseous overhead of the second column 65 can be used as fuel gas. From the bottom of the second column 65 a liquid bottom stream is removed, wherein part of the liquid bottom stream is returned to the bottom of the second column 65 through conduit 69 provided with a reboiler 73 to vaporize that part of the liquid bottom stream. The remainder of the liquid bottom stream is introduced into a crude oil stream at an appropriate point in or upstream of the stabilization unit 4. In the embodiment shown in the drawing the remainder is passed through conduit 75 and mixed with the oil in conduit 32.

The second column 65 is a stripping column operating at lower pressure than the first column 47. The fraction of the liquid bottom stream of the second column 65 that is vaporized is so selected that the concentration of $C_2^-$ in the liquid bottom stream is below a predetermined level. Suitably the $C_2^-$ concentration is below between 1 mol % and more suitably below 0.2 mol %.

In summary the essence of the present invention resides in the following features, stabilizing the crude in a known stabilization unit 3, operating the first column 47 at an elevated pressure, controlling the reflux of the first column 47 so that the gaseous overhead is so rich in methane that it can be passed directly to a liquefaction plant, operating the second column 65 at a lower pressure, controlling the reboiling of the second column 65 such that the liquid bottom stream has a sufficiently low $C_2^-$-content, and mixing the liquid bottom stream with crude oil upstream the fractionation unit 4. On its own the liquid bottom stream removed from the second column 75 is not stable at atmospheric conditions, but the mixture of this stream with the crude oil is stable because the lighter hydrocarbons will dissolve in the crude oil.

The stabilization unit discussed with reference to the drawing has three separation stages for separating gas and liquid, which are the separators 20, 26 and 35. However, any suitable number of separation stages can be employed, depending on the particular crude that is to be treated. The conditions in the stabilization unit are known and will not be discussed in more detail.

Suitably, the elevated pressure in the first column 47 is in the range of from 4 to 7 MPa, and the low temperature of the gaseous stream that is supplied through conduit 46 is in the range of from −10 to −20° C.

Suitably the expanded bottom stream is supplied to the top of a second column 65 at a temperature that is below the low temperature of the cooled gaseous stream, and more suitably, this temperature is in the range of from −20 to −40° C. Suitably the lower pressure with which the bottom stream from the first column 47 is supplied to the top of the second column 65 is in the range of from 2.5 to 3 MPa.

In the embodiment shown in the drawing, the liquid bottom stream from the second column 65 is introduced into the crude oil stream between the second and third separation stage of stabilization unit 3. The appropriate point at which this remainder can be introduced into the crude oil stream can be in conduit 6, or in between any of the separation stages.

The gas that is passed through conduit 10 to the fractionation unit 4 is suitably treated upstream of the fractionation unit 4. The treatment includes removing contaminants such as carbon dioxide from the gas, and drying the gas. The treating units have not been shown in the drawing.

What is claimed is:

1. A process for producing a methane-rich stream from a crude containing natural gas, which process comprises:

(a) supplying the crude to a stabilization unit to obtain a gaseous stream and crude oil;

(b) cooling the gaseous stream at an elevated pressure and supplying the gaseous stream at a low temperature to the bottom of a first column;

(c) removing from the top of the first column a first gaseous overhead stream, partly condensing the gaseous overhead stream, separating the liquid phase from the partly condensed overhead stream to obtain a methane-rich stream, returning the liquid phase to the top of the first column;

(d) removing a bottom stream from the first column, allowing the bottom stream to expand to a lower pressure, and supplying the expanded bottom stream at a low temperature to the top of a second column;

(e) removing from the top of the second column a second gaseous overhead stream, and removing from the bottom of the second column a liquid bottom stream;

(f) vaporizing part of the liquid bottom stream and introducing the vapour into the bottom of the second column; and (g) introducing the remainder of the liquid bottom stream into a crude oil stream at an appropriate point in or upstream of the stabilization unit, wherein the amount of heat removed from the first gaseous overhead stream is so adjusted that the concentration of $C_5^+$ in the first gaseous overhead stream is below a predetermined value, and wherein the fraction of the liquid bottom stream from the second column that is vaporized is so selected that the concentration of $C_2^-$ in the liquid bottom stream is below a predetermined level.

2. The process of claim 1, wherein the elevated pressure in step (b) is in the range of from 4 to 7 MPa, and wherein the low temperature is in the range of from −10 to −20° C.

3. The process of claim 1, wherein the expanded bottom stream in step (d) is supplied to the top of a second column at a temperature that is below the low temperature in step (b).

4. The process of claim 1, wherein the lower pressure in step (d) is in the range of from 2.5 to 3 MPa, and wherein the low temperature is in the range of from −20 to −40° C.

5. The process of claim 1, wherein the predetermined value of $C_5^+$ is 0.1 mol %.

6. The process of claim 5, wherein the predetermined level of $C_2^-$ is 1 mol %.

7. The process of claim 1, wherein the predetermined level of $C_2$– is 1 mol %.

8. The process of claim 1, wherein step (c) further comprises supplying the methane-rich stream to a liquefaction plant.

9. A process for producing a liquefied methane-rich stream from a crude containing natural gas, which process comprises:

(a) supplying the crude to a stabilization unit to obtain a gaseous stream and crude oil;

(b) cooling the gaseous stream at an elevated pressure and supplying the gaseous stream at a low temperature to the bottom of a first column;

(c) removing from the top of the first column a first gaseous overhead stream, partly condensing the gaseous overhead stream, separating the liquid phase from the partly condensed overhead stream to obtain a methane-rich stream, returning the liquid phase to the top of the first column and supplying the methane-rich stream to a liquefaction plant;

(d) removing a bottom stream from the first column, allowing the bottom stream to expand to a lower pressure, and supplying the expanded bottom stream at a low temperature to the top of a second column;

(e) removing from the top of the second column a second gaseous overhead stream, and removing from the bottom of the second column a liquid bottom stream;

(f) vaporizing part of the liquid bottom stream and introducing the vapour into the bottom of the second column; and (g) introducing the remainder of the liquid bottom stream into a crude oil stream at an appropriate point in or upstream of the stabilization unit, wherein the amount of heat removed from the first gaseous overhead stream is so adjusted that the concentration of $C_5^+$ in the first gaseous overhead stream is below a predetermined value, and wherein the fraction of the liquid bottom stream from the second column that is vaporized is so selected that the concentration of $C_2^-$ in the liquid bottom stream is below a predetermined level.

10. The process of claim 9, wherein the elevated pressure in step (b) is in the range of from 4 to 7 MPa, and wherein the low temperature is in the range of from −10 to −20° C.

11. The process of claim 9, wherein the expanded bottom stream in step (d) is supplied to the top of a second column at a temperature that is below the low temperature in step (b).

12. The process of claim 9, wherein the lower pressure in step (d) is in the range of from 2.5 to 3 MPa, and wherein the low temperature is in the range of from −20 to −40° C.

13. The process of claim 9, wherein the predetermined value of $C_5^+$ is 0.1 mol %.

14. The process of claim 13, wherein the predetermined level of $C_2^-$ is 1 mol %.

15. The process of claim 9, wherein the predetermined level of $C_2^-$ is 1 mol %.

16. A process for treating a crude containing natural gas, which process comprises:

(a) supplying the crude to a stabilization unit to obtain a gaseous stream and crude oil;

(b) cooling the gaseous stream at an elevated pressure and supplying the gaseous stream at a low temperature to the bottom of a first column;

(c) removing from the top of the first column a first gaseous overhead stream, partly condensing the gaseous overhead stream, separating the liquid phase from the partly condensed overhead stream to obtain a methane-rich stream, returning the liquid phase to the top of the first column and supplying the methane-rich stream to a liquefaction plant;

(d) removing a bottom stream from the first column, allowing the bottom stream to expand to a lower pressure, and supplying the expanded bottom stream at a low temperature to the top of a second column;

(e) removing from the top of the second column a second gaseous overhead stream, and removing from the bottom of the second column a liquid bottom stream;

(f) vaporizing part of the liquid bottom stream and introducing the vapour into the bottom of the second column; and (g) introducing the remainder of the liquid bottom stream into a crude oil stream at an appropriate point in or upstream of the stabilization unit, wherein the amount of heat removed from the first gaseous overhead stream is so adjusted that the concentration of $C_5^+$ in the first gaseous overhead stream is below a predetermined value, and wherein the fraction of the liquid bottom stream from the second column that is vaporized is so selected that the concentration of $C_2^-$ in the liquid bottom stream is below a predetermined level.

17. The process of claim 16, wherein the predetermined value of $C_5^+$ is 0.1 mol %.

18. The process of claim 17, wherein the predetermined level of $C_2^-$ is 1 mol %.

19. The process of claim 16, wherein the predetermined level of $C_2^-$ is 1 mol %.

* * * * *